United States Patent [19]

MacNitt, Jr. et al.

[11] Patent Number: 4,527,410

[45] Date of Patent: Jul. 9, 1985

[54] BLADE TWISTING APPARATUS

[75] Inventors: Donald G. MacNitt, Jr., Singer Island; Larry N. Fuss, Lake Park, both of Fla.

[73] Assignee: United Technologies Corporation, Hartford, Conn.

[21] Appl. No.: 564,451

[22] Filed: Dec. 22, 1983

[51] Int. Cl.[3] ..... B21D 53/78

[52] U.S. Cl. ..... 72/306; 72/415; 72/385; 29/156.8 R; 29/23.5

[58] Field of Search ..... 29/156.8 R, 23.5, 156.8 CF; 72/306, 293, 414, 412, 415, 385

[56] References Cited

U.S. PATENT DOCUMENTS

| | | | |
|---|---|---|---|
| 1,909,097 | 5/1933 | Damerell | 29/156.8 P |
| 2,448,179 | 8/1948 | Gruetjen | 29/156.8 P |
| 2,467,344 | 4/1949 | Taylor | 29/156.8 CF |
| 2,828,531 | 4/1958 | Bath | 29/156.8 P |
| 3,032,092 | 5/1962 | Erlbacher | 72/293 |
| 4,150,557 | 4/1979 | Walker et al. | 72/403 |
| 4,222,259 | 9/1980 | Junes | 29/156.8 P |

FOREIGN PATENT DOCUMENTS

| | | | |
|---|---|---|---|
| 355779 | 11/1905 | France | 72/415 |

*Primary Examiner*—Daniel C. Crane

*Attorney, Agent, or Firm*—Stephen E. Revis

[57] ABSTRACT

Apparatus for increasing the twist of blades of an integrally bladed rotor comprise a plurality of pairs of opposed, aligned blade formers, slideably disposed in guide channels on opposite sides of the blades to be twisted. The rotor and twisting apparatus is heated and the opposed formers are forced toward each other. The blade disposed between each pair of formers is sandwiched between the ends of the formers. The ends of the formers are specially shaped such that the blades are reshaped or twisted to the desired final contour.

6 Claims, 6 Drawing Figures

BLADE TWISTING APPARATUS

The Government has rights in the invention pursuant to Contract No. F33615-80-C-5134 awarded by the Department of the Air Force.

TECHNICAL FIELD

This invention relates to forming rotor blades, and more particularly to apparatus for twisting the blades of an integrally bladed rotor.

BACKGROUND ART

Forming rotors with blades integral with the rotor disk is well known in the art. For example, apparatus for forging integrally bladed rotors from difficult to forge superalloys and other materials is shown in commonly owned U.S. Pat. No. 4,150,557 to Bryant H. Walker et al. In forging apparatus of the type shown in the Walker et al patent, blade forming dies are positioned about the rim of a billet or preform which is to be forged to a near net shape bladed rotor. During the forging operation the billet material is forced radially outwardly into the cavities formed by the blade forming dies. Removing the forged rotor from the apparatus requires removing or moving the blade forming dies from between the forged blades. There is a limit to the amount of twist the blades can have to permit the rotor to be removed without having to destroy the dies. If it is required that the blades have a twist or other shape which is beyond this limit, the blades must be thereafter further formed.

Automated apparatus for performing this additional forming or twisting economically and with precision is not known in the prior art. What is known is to individually grasp and twist the tip portion of each blade with a special plier-like tool. That method cannot be used to control the final blade shape with great accuracy. In other words, the rate of twist in the finished blade and the contour of its pressure and suction surfaces over the length of the blade cannot be fully controlled.

DISCLOSURE OF INVENTION

One object of the present invention is apparatus for adding twist to preliminarily formed blades of an integrally bladed rotor.

Another object of the present invention is apparatus for simultaneously and accurately increasing the twist and/or changing the contour of a plurality of blades of an integrally bladed rotor over the blades' full length.

According to the present invention, apparatus for increasing the twist of the blades of an integrally bladed rotor comprises a plurality of pairs of opposed, complementary blade formers, the formers of each pair being disposed in guide channels on opposite sides of a rotor blade to be twisted, one of each pair of formers having an end surface shaped to the desired final configuration of one side of the blade and the other of the pair of formers having an end surface shaped to the final configuration of the other side of the blade to be twisted, the apparatus including means for simultaneously forcing the shaped end surfaces of paired blade formers toward each other with the blades between them until the end surfaces of the formers are simultaneously contiguous with the opposing surfaces of the blade.

More specifically, the rotor having the blades to be twisted is disposed in a fixture which holds it stationary. The rotor is heated to a temperature which reduces the forces required to twist the blades, decreases blade brittleness to avoid cracking the blades, and eliminates elastic springback of the blade material after the forming forces are removed. Preferably the twisting operation is done under isothermal conditions. A plurality of pairs of complementary blade formers are slideably disposed in guide channels. The formers of each pair are disposed on opposite sides of the rotor and aligned with each other and with the blade to be twisted which is disposed between them. One former of each pair has its end nearest the blade shaped to the final configuration of the pressure side of the blade, and the other former has its end nearest the blade shaped to the final configuration of the suction side of the blade. Means is provided to simultaneously push the pairs of blade formers toward each other within their respective guide channels into contact with their corresponding blades until the shaped end surfaces of the formers are in contiguous contact with their respective blade surfaces, whereby the blade is then in its final desired configuration.

The number of blades on the rotor which may be twisted at the same time depends upon the spacing between adjacent blades, since the blade former ends must move between adjacent blades during the forming operation and not interfere with adjacent blade formers. It is expected that, with the present invention, at least every other blade may be twisted simultaneously such that two separate operations would be required to twist all the blades.

The foregoing and other objects, features and advantages of the present invention will become more apparent in the light of the following detailed description of preferred embodiments thereof as shown in the accompanying drawings.

BEST MODE FOR CARRYING OUT THE INVENTION

In connection with the present invention, an integrally bladed rotor is preliminarly formed (i.e. preformed), such as by forging or other suitable means. For purposes of the present invention it is assumed that the required twist in the blades of the finished rotor cannot be accomplished in the preliminary forming operation: therefore, it is necessary that the blades be further shaped or twisted to their final configuration. This is done using the apparatus of the present invention as depicted schematically and in a simplified manner in FIG. 1.

Figure 1:
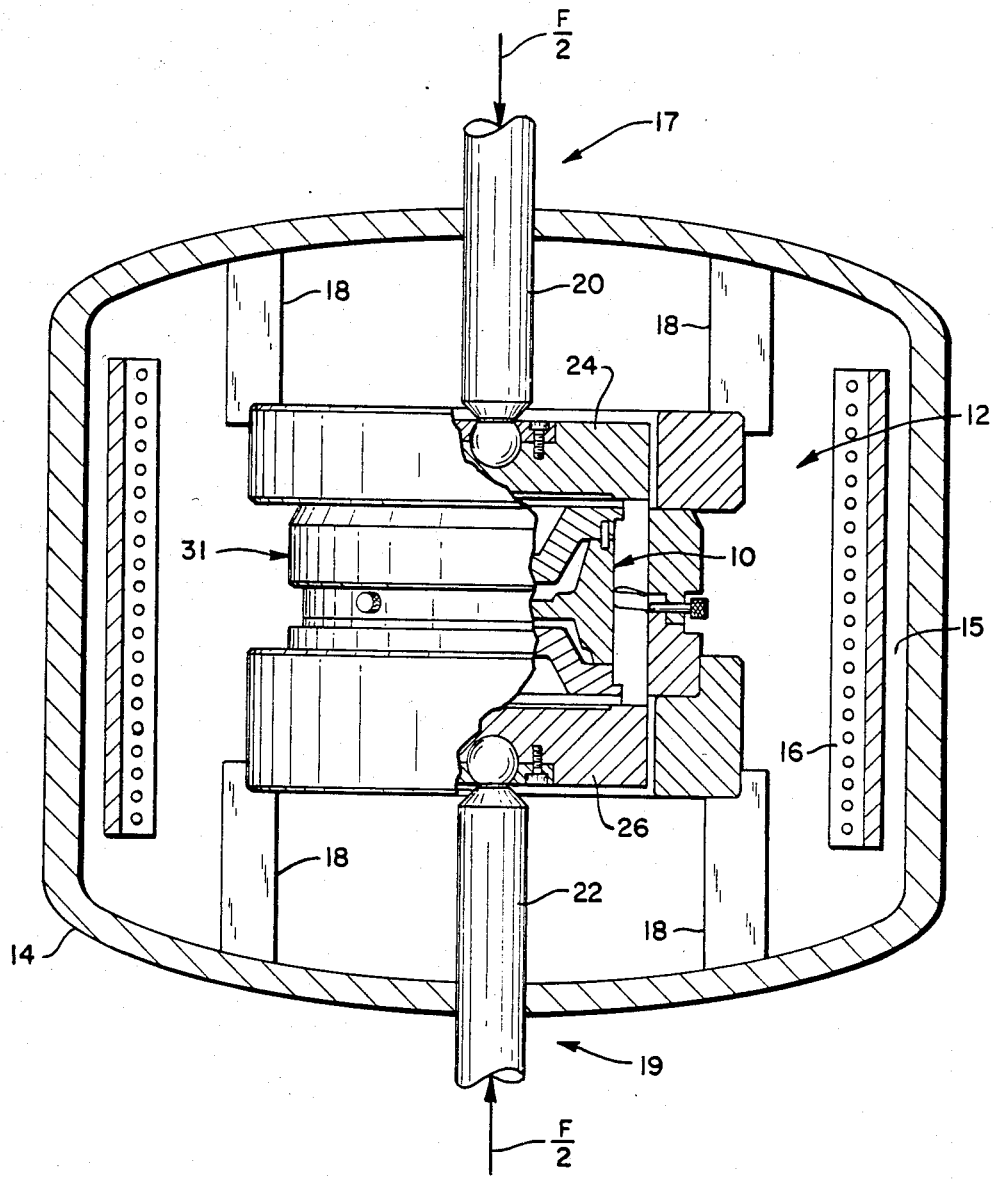
FIG. 1 is a schematic, simplified view, partly in section, of blade twisting apparatus according to the present invention disposed within a containment vessel.

With reference to FIG. 1, the pre-formed rotor is designated by the reference numeral 10. The rotor 10 is held securely within a fixture generally represented by the reference numeral 12. The fixture 12 is disposed within a containment vessel 14 which defines a heating chamber 15. The fixture 12 is surrounded by a heating coil 16 and is held securely in position within the containment vessel 14 by suitable means represented schematically by the elements 18. As will be made clearer by the description to follow, a force F for shaping and twisting the blades of the rotor 10 is applied by opposed upper and lower presses 17, 19 comprising upper and lower vertically moveable shafts 20, 22, respectively, which are secured to upper and lower platens 24, 26, respectively.

Figure 2:
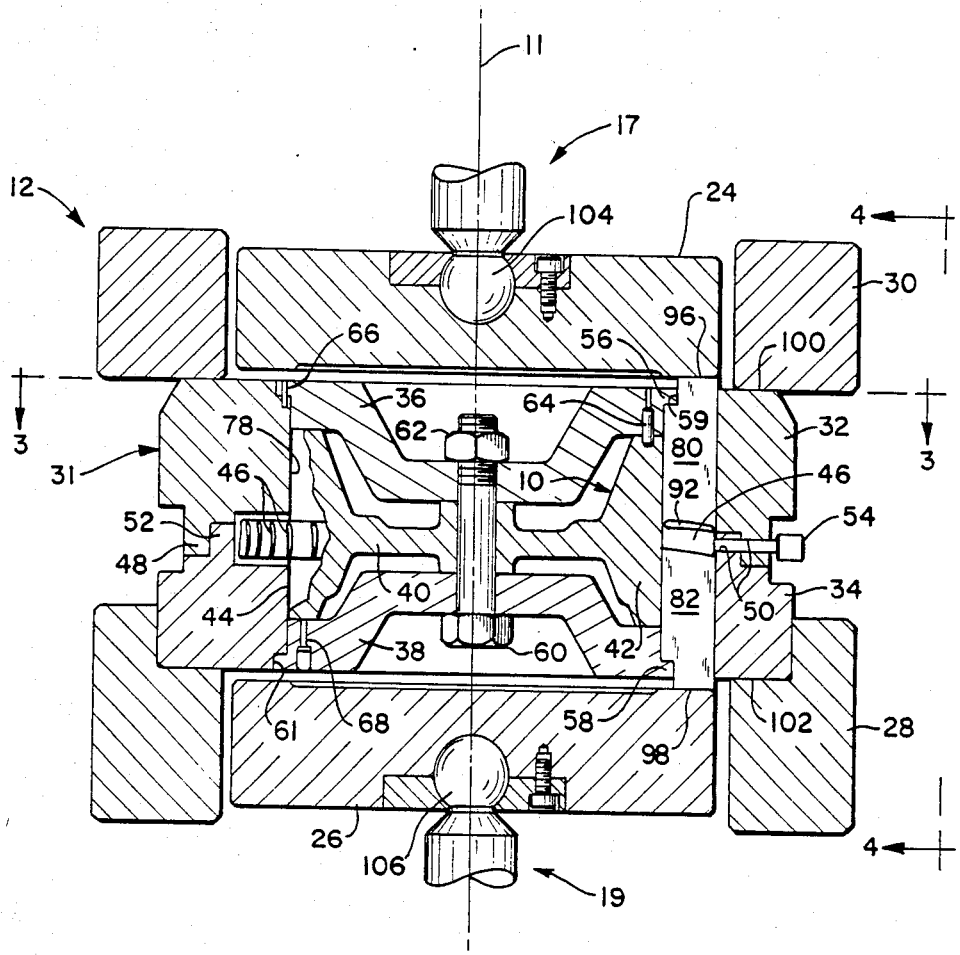
FIG. 2 is an enlarged view, partly broken away, of the blade twisting apparatus of FIG. 1 just before the blades are twisted.

FIG. 2 shows the rotor 10 and fixture 12 in more detail. The rotor 10 has an axis 11. The fixture 12 includes a retaining ring 28, a stop ring 30, and a blade former guide assembly 31. The guide assembly 31 is securely and fixedly held between the retaining ring 28 and stop ring 30. The guide assembly 31 comprises an upper annular guide ring 32, lower annular guide ring 34, and upper and lower support disks 36, 38, respectively, all of which are coaxial with the rotor 10.

The rotor 10 includes a disk portion 40 having an enlarged axially extending rim 42 defining an outwardly facing cylindrical surface 44. A plurality of blades 46 extend radially outwardly from the rim 42 and are integral therewith. The rotor 10 is sandwiched axially between the upper and lower support disks 36, 38, and is surrounded by the upper and lower guide rings 32, 34 which contact the outwardly facing cylindrical surface 44 of the rim 42.

The upper guide ring 32 includes an axially extending annular flange 48 which overlaps and mates with an axially extending annular flange 52 of the lower guide ring 34. Each flange 48, 52 includes a plurality of circumferentially spaced apart, radially extending holes 50, the holes in one flange being aligned with the holes in the other flange when the guide rings are properly positioned. Locating means, such as the pins 54, are disposed within the aligned holes to precisely maintain the correct positions of the upper and lower guide rings 32, 34 relative to each other for purposes which will hereinafter become apparent. A radially outwardly extending annular flange 56 on the upper support disk 36, and a radially outwardly extending annular flange 58 on the lower support disk 38 mate with annular grooves 59, 61 in the upper and lower guide rings 32, 34, respectively, thereby trapping said guide rings axially therebetween. A threaded bolt 60 and corresponding nut 62 are used to hold the guide assembly 31 together. Additional locating means, such as the pins 64, 66, 68, disposed in precisely located aligned holes, correctly orient the rotor 10, support disks 36, 38 and guide rings 32, 34 relative to each other.

Figure 4:
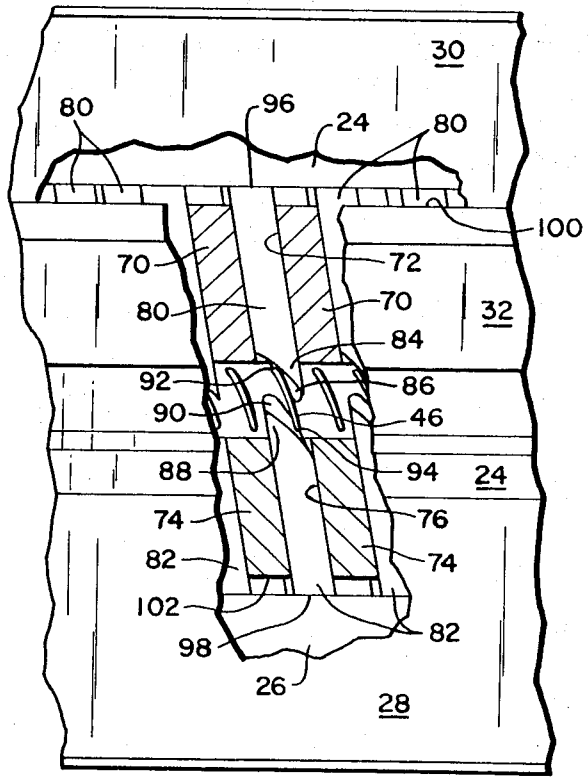
FIG. 4 is a view, partly broken away, taken generally in the direction 4—4 of FIG. 2.
Figure 3:
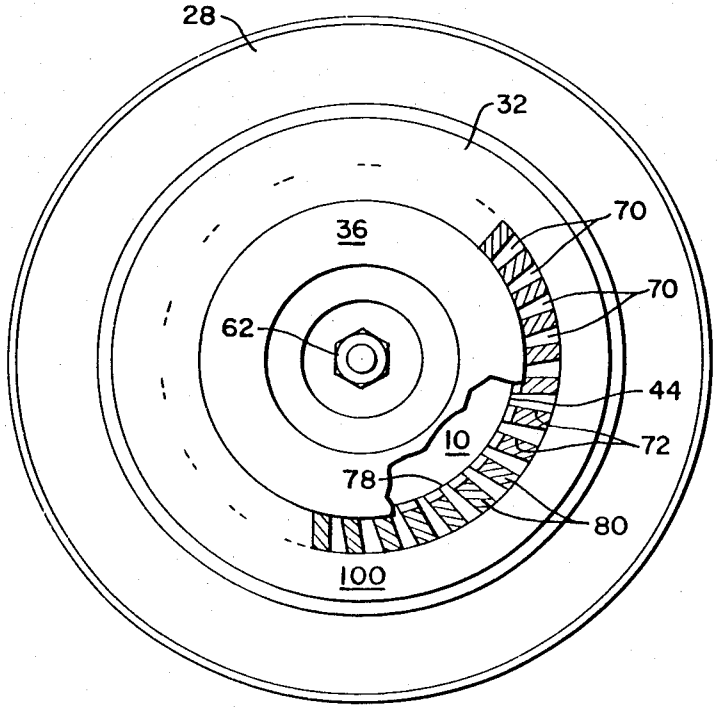
FIG. 3 is a sectional view taken generally along the lines 3—3 of FIG. 2.

In accordance with the present invention, and as best seen in FIGS. 3 and 4, the upper guide ring 32 includes a plurality of circumferentially spaced apart, radially inwardly extending ribs 70 which define axially extending upper guide channels 72 therebetween. Similarly, the lower guide ring 34 includes a plurality of circumferentially spaced apart, radially inwardly extending ribs 74 which define a plurality of axially extending lower guide channels 76 therebetween. Each upper guide channel 72 is aligned with a corresponding lower guide channel 76 on opposite sides of a blade 46 to be twisted. In this embodiment, there is a pair of aligned guide channels 72, 76 for every other blade of the rotor 10.

With reference to FIGS. 1–4, slideably disposed within each upper guide channel 72 is an elongated upper blade former 80. Slideably disposed within each lower guide channel 76 is an elongated lower blade former 82. The inner end 84 of the upper blade former 80 (i.e. the end nearest the blade 46 with which it is aligned) has a shaped end surface 86. Similarly, the inner end 88 of the lower blade former 82 has a shaped end surface 90 which complements the end surface 86 of the blade former 80 with which it is aligned. In FIGS. 1–4 the blades 46 have not yet been twisted by the apparatus. The leading edge 92 of each blade 46 to be twisted contacts a portion of the end surface 86 of its respective upper blade former 80. The trailing edge 94 of each blade to be twisted is in contact with a portion of the end surface 90 of its respective lower blade former 82. The outer ends 96, 98 of the blade formers 80, 82, respectively, extend slightly above the surfaces 100, 102 of the guide rings 32, 34, respectively, and are in contact with the platens 24, 26.

Figure 5:
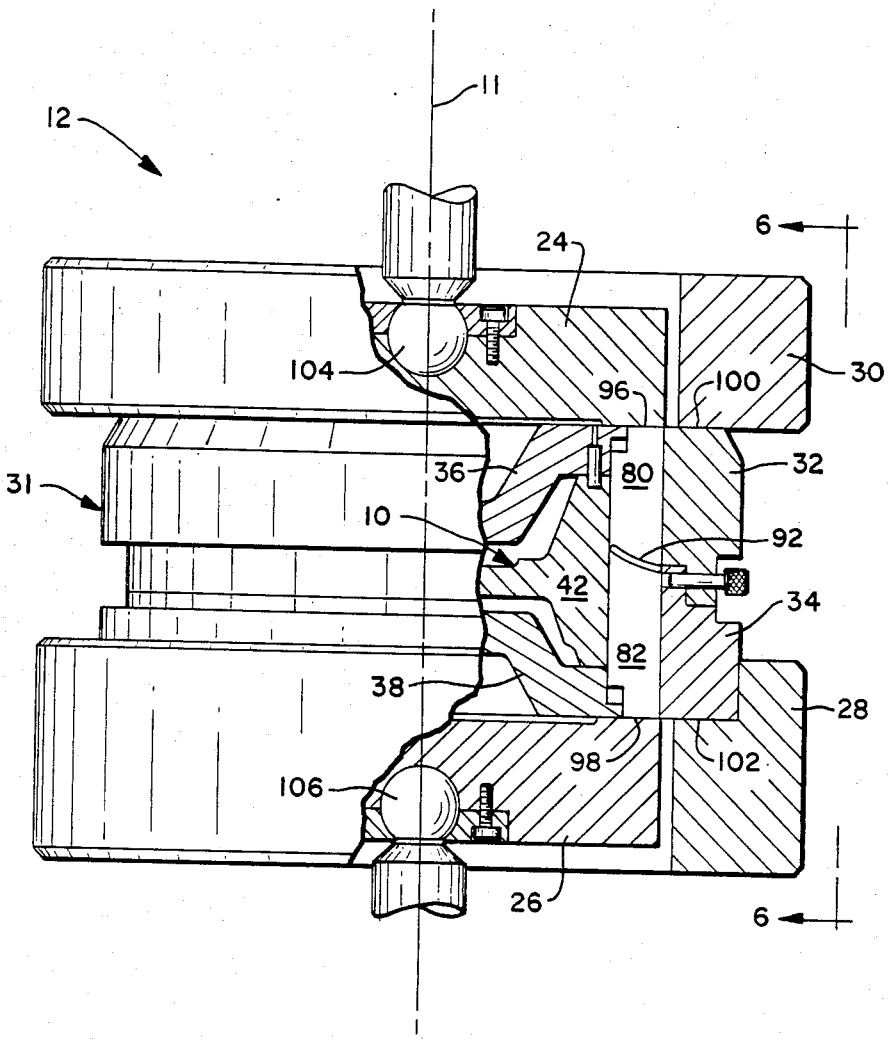
FIG. 5 is a view similar to that of FIG. 2, showing the blade twisting apparatus of the present invention just after the blades are twisted.
Figure 6:
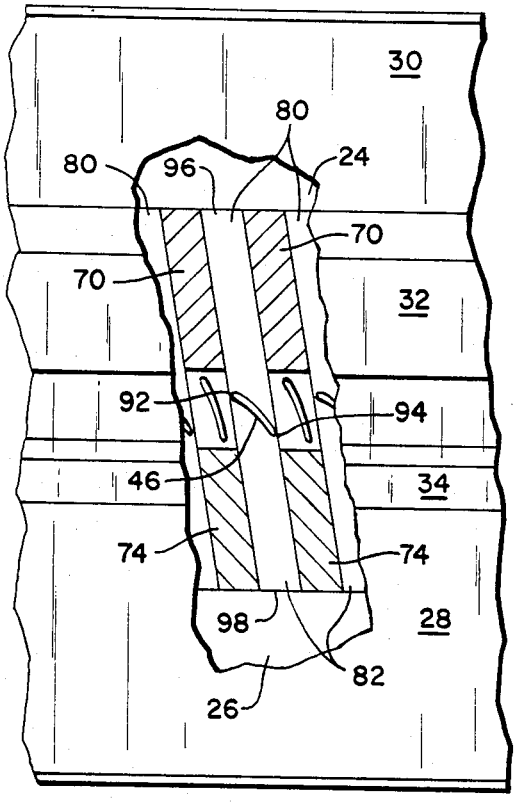
FIG. 6 is a view, partly broken away, taken generally in the direction 6—6 of FIG. 5.

FIGS. 5 and 6 show the apparatus after the platens have been moved toward each other simultaneously until they are flush with surfaces 100, 102 of the guide rings. As the platens 24, 26 are moved from the position shown in FIGS. 2–4 to the position shown in FIGS. 5 and 6, the aligned pairs of complementary blade formers 80, 82 are simultaneously forced toward each other and twist and reshape the blades 46 disposed between them. The end surfaces 86 of the upper blade formers 80 are shaped to the desired final contour of the suction surface of the blades 46; and the end surfaces 90 of the lower blade formers 82 are shaped to the desired final contour of the pressure surface of the blades 46. When a pair of aligned blade formers 80, 82 has been moved to its final position, the surface 86 of the upper former 80 is substantially contiguous with the entire suction surface of a blade 46 from the tip to the base of the blade; and the end surface 90 of the lower former 82 is substantially contiguous with the entire pressure surface of the same blade 46 from its tip to base. The blade 46 is thus sandwiched between the end surfaces 86, 90 of the formers 80, 82 respectively. By moving the blade formers 80, 82 toward each other simultaneously, each blade may be twisted about the airfoil radially extending stacking line without "bending" the stacking line.

As can be seen in FIG. 4, the guide channels 72, 76 extend in a direction which is at an angle relative to the axis of the rotor and which direction is substantially in a plane perpendicular to a radial line. In this embodiment the angling was required to avoid interference between the blade formers and the blades on either side of a blade to be twisted due to the close spacing between adjacent rotor blades and their final angular orientation. As a result of the angled orientation of the blade formers, as they move toward each other their outer ends 96, 98 move not only in an axial direction but also perpendicular to the axial direction and substantially tangent to a circle about the rotor axis. To accommodate this nonaxial movement, the platens 24, 26 are joined to their respective shafts 20, 22 by means of ball joints 104, 106. The ball joints 104, 106 permit the platens to rotate about the axis of the rotor 10. This virtually eliminates relative motion between the blade former ends 96, 98 and the platens 24, 26, as the platens push the blade formers toward each other during the twisting operation. If the joints between the platens and their respective shafts were rigid, there would necessarily be sliding between the blade former ends and the platens resulting in increased nonradial forces on the blade formers which could cause undue wear on the formers and guide channels.

To demonstrate the operability of the apparatus of the present invention an integrally bladed rotor was formed from AMS 4928 which is a titanium-/aluminum/vanadium alloy. This rotor was forged in accordance with the teachings of commonly owned U.S. Pat. No. 3,519,503. In the process described in that patent, which process is known internationally as the GATORIZING ® forging process, high strength, difficult to forge alloys are processed to a temporary state of low strength and high ductility so as to enable the flow of billet material into forging die cavities having intricate contours or complex shapes. In the present example, the rotor was forged under isothermal conditions at a temperature of about 1750° F. The finished rotor was approximately 5.5 inches in diameter and comprised 70 blades each about 1.0 inch long and 0.5 inch wide, each blade being tapered from a maximum thickness near its base of about 0.09 inch to a maximum thickness at its tip of about 0.05 inch. This forged rotor was placed in blade twisting apparatus very similar to that shown and described hereinabove. The apparatus was disposed in a containment vessel filled with inert gas and analogous to the containment vessel of FIG. 1. The blade formers and the surfaces of the blade former guide channels were coated with boron nitride as a lubricant. The apparatus and rotor were heated to a temperature between 1250° and 1300° F. The blades were then twisted under isothermal conditions. The temperature was high enough to avoid elastic springback of the blades after twisting and to put the blade material into a condition which would permit twisting without causing cracking of the blade material. The upper temperature limit of 1300° F. was selected to assure that no movement or plastic deformation of the precisely located and dimensioned guide channel forming ribs would occur. The twisting operation successfully increased the twist from blade base to tip by about 20 degrees.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. Apparatus for increasing the twist of blades of an integrally bladed rotor from a first to a second degree of twist, the rotor comprising a disk having an axis and a rim, a plurality of blades extending radially outwardly from the rim and integral therewith, the blades having a base, a tip, a pressure surface, and a suction surface, said apparatus comprising:

first guide means disposed about an axis defining a plurality of first axially extending guide channels disposed on one side of the blades to be twisted;

second guide means disposed coaxially with said first guide means defining a plurality of second axially extending guide channels disposed on the other side of the blades to be twisted;

fixture means for holding an integrally bladed rotor stationary and in position between said first and second guide means and fixed relative to said guide means;

a pair of complementary blade forming means corresponding to each blade to be twisted, a first one of each pair being disposed in one of said first guide channels for sliding movement in an axial direction within said first guide channel between a first and second position toward the suction side of its corresponding blade and having a forming end adapted to continuously contact said blade suction surface during said movement, said forming end further having a surface substantially the contour of the blade suction surface in its desired second degree of twist configurations, said end surface adapted to be substantially contiguous with said suction surface when said forming means is in said second position;

the second one of each pair of blade forming means being disposed in one of said second guide channels for sliding movement in an axial direction within said first guide channel between a first and second position toward the pressure side of its corresponding blade and having a forming end adapted to continuously contact said blade pressure surface during said movement, said forming end further having a surface substantially the contour of the blade pressure surface in its desired second degree of twist configuration, said end surface adapted to be substantially contiguous with said pressure surface when said forming means is in said second position; and press means disposed adjacent said blade forming means for simultaneously moving said pairs of blade forming means from their first to second position.

2. The blade twisting apparatus according to claim 1 wherein said first and second guide means includes wall means defining a cylindrical cavity having an axis adapted to be colinear with the axis of the rotor, said guide channels being circumferentially spaced apart about the periphery of said cavity, each of said first guide channels being paired with one of said second guide channels, each of said pairs of complementary blade forming means being disposed in one of said pairs of channels, said blade forming means of each pair being aligned with each other.

3. The blade twisting apparatus according to claim 2 wherein said first and second guide channels extend in a direction which is at an angle relative to an axial line and is substantially in a plane perpendicular to a radial line.

4. The blade twisting apparatus according to claim 3 wherein each of said blade forming means has a distal end opposite to said forming end, said press means including first and second opposed, spaced apart plates each having a flat surface perpendicular to said cavity axis, said first plate adapted to contact said distal ends of said blade forming means disposed in said first channels and said second plate adapted to contact said distal ends of said blade forming means disposed in said second channels, said press means adapted for moving said plates toward each other simultaneously along said cavity axis to move said blade forming means from their first to their second positions.

5. The blade twisting apparatus according to claim 4 wherein said plates are rotatable about said cavity axis.

6. The blade twisting apparatus according to claim 2 wherein said first and second guide means each include cylindrical, radially inwardly facing surface means having axially and radially inwardly extending, circumferentially spaced apart ribs integral therewith, said ribs of said first guide means defining said first guide channels therebetween, and said ribs of said second guide means defining said second guide channels therebetween.

* * * * *